United States Patent [19]

Dornbach, Jr.

[11] 3,991,941

[45] Nov. 16, 1976

[54] GAS BURNER

[75] Inventor: William H. Dornbach, Jr., Eastlake, Ohio

[73] Assignee: Dornback Furnace and Foundry Co., Eastlake, Ohio

[22] Filed: Jan. 24, 1975

[21] Appl. No.: 543,680

[52] U.S. Cl. ..... 239/552; 239/554; 239/555; 431/354

[51] Int. Cl.[2] ..... B05B 1/14

[58] Field of Search ..... 431/286, 354; 239/552, 239/553, 554, 555, 557

[56] References Cited

UNITED STATES PATENTS

| | | | |
|---|---|---|---|
| 1,919,788 | 7/1933 | Kielberg | 239/557 |
| 2,348,011 | 5/1944 | Koppel | 239/552 |
| 2,588,895 | 3/1952 | Tavener | 239/552 |
| 2,607,405 | 8/1952 | Weinandy | 431/286 |
| 3,092,168 | 6/1963 | Phlaum | 431/286 |
| 3,658,256 | 4/1972 | Hartzell | 239/552 |
| 3,818,937 | 6/1974 | La Ganke | 431/354 |

*Primary Examiner*—Carroll B. Dority, Jr.
*Attorney, Agent, or Firm*—Oldham & Oldham Co.

[57] ABSTRACT

An elongated gas burner including a frame formed from a plurality of metal members secured together to form an enclosure having an open end, and having a series of longitudinally spaced openings in an upper portion thereof, which openings have a dividing member extending thereacross for forming twin gas burner ports when the burner is used.

4 Claims, 4 Drawing Figures

GAS BURNER

Heretofore, a number of different kinds of gas burners have been provided. Some of these prior burners are made from drilled pipes, castings, pierced tubes, or the like. Also, some burners as provided heretofore have been provided with variable ports therein for burning different kinds of natural or manufactured gasses or mixtures thereof. The burners have been relatively heavy in some instances, and some burners have not provided heat uniformly of the burner length.

The general object of the present invention is to provide a novel, improved gas burner made from a plurality of metal stampings secured together to form an elongated burner which has a decreasing cross-sectional area progressively with the length thereof from an input end of the burner.

Another object of the invention is to provide a burner wherein the air-to-gas ratio can be readily adjusted to provide maximum air supply without the flames lifting from the gas ignition ports and to provide a quality, economical combustion action.

A further object of the invention is to provide a gas burner wherein the flame characteristics at the extreme end of the burner are exactly the same as at the orifice end to provide even heat over the entire heat exchangers surfaces.

A further object of the invention is to provide a high velocity of a fuel-air mixture to a burner for increased efficiency thereof, and economical use of the gas fuel.

Yet another object of the invention is to provide an elongated light-weight gas burner which has a side or crossover arm on each burner so as to enable control of a plurality of burners with just one pilot burner.

Attention is now directed to the accompanying drawings, wherein.

When referring to corresponding members shown in the drawings and described in the specification, corresponding numerals are used to facilitate comparison therebetween.

SUBJECT MATTER OF INVENTION

The gas burner of the invention, as one embodiment thereof, comprises an elongated frame formed from a plurality of metal members, such as substantially U-shaped stampings, that are secured together adjacent their upper ends to form an elongate enclosure which has a series of longitudinally spaced openings in an upper portion thereof, normally at or adjacent the upper ends of each of the arms of the U-shaped structure, and a dividing bar is positioned to extend along the enclosure and across the openings to form twin gas jet ports therefrom, the enclosure normally decreasing in cross-sectional area progressively from an input end thereof to aid in providing uniform gas flow and pressures from all gas port openings in the burner.

Figures 1, 3, 4:
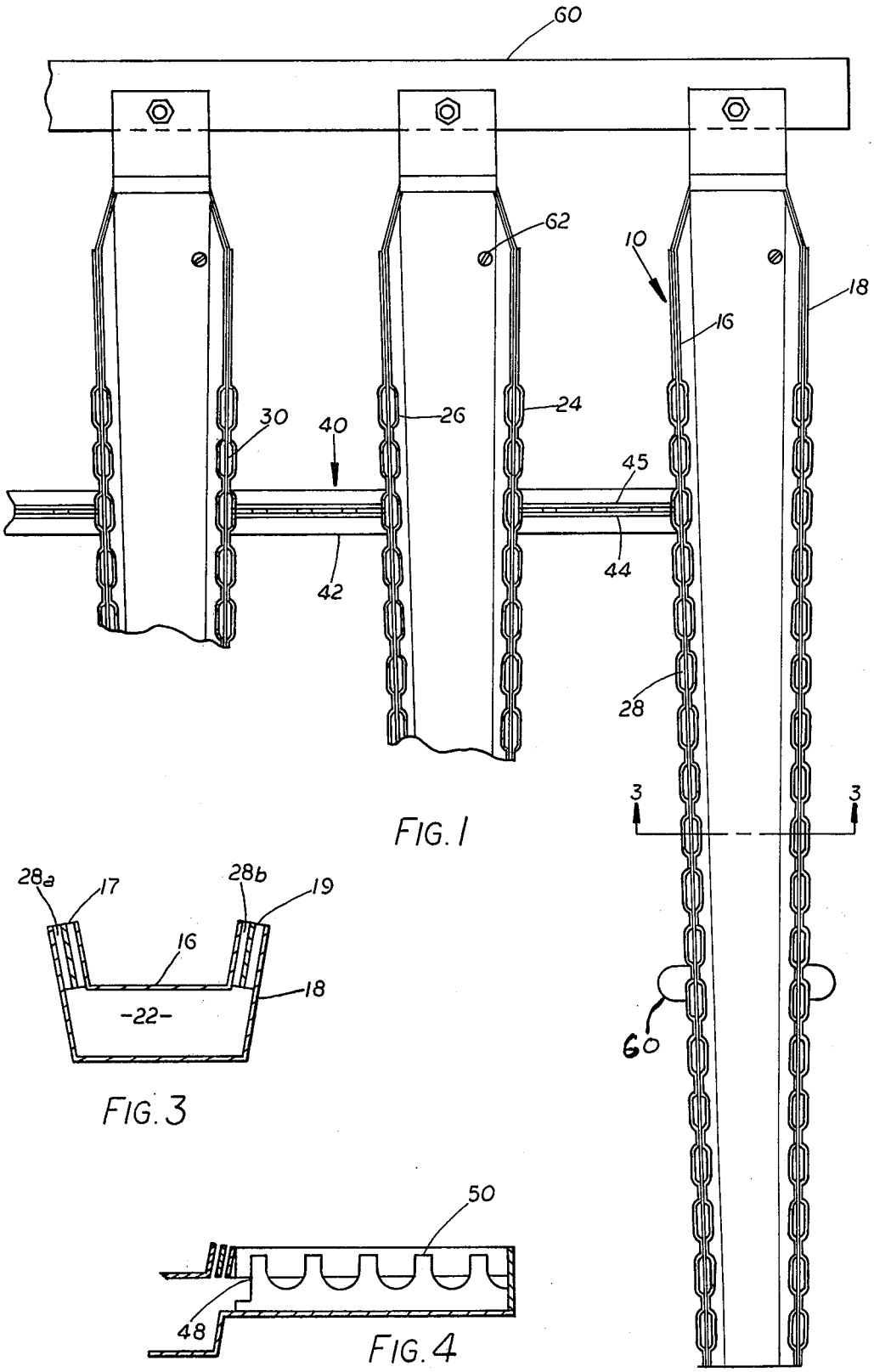
FIG. 1 is a plan view of a plurality of burners of the invention as operatively positioned.
FIG. 3 is a vertical section taken on line 3—3 of FIG. 1.
FIG. 4 is a longitudinal center section through the crossover arm of the burner of FIG. 1.

Reference now is made to the details of the structure shown in the drawings, and a gas burner of the invention is indicated as a whole by the numeral 10. FIG. 1 shows a plurality of these gas burners 10 in operative association with a gas supply manifold 12. Each burner has an open input end 14 positioned adjacent the manifold 12.

The burners preferably are formed from a plurality of metal members, and specifically the burners as shown each are formed from a pair of metal stampings, each of substantially U-shape in section and made, for example, from 20 gage cold rolled steel. An upper stamping 16 is used and is smaller than a lower stamping 18; the arms 17 and 19 of such stampings are shaped to abut at the upper portions thereof and with the stampings being secured together to form an air tight enclosure 22 therebetween, as by a plurality of longitudinally spaced spot welds 20. However, prior to securing the stampings together to form the center enclosure 22 thereby, portions of the arms are stamped to shaped contours to provide gas ports for the burner. Thus, for example, the lower stamping 18 is provided with a plurality of longitudinally spaced outwardly bowed sections 24 and the upper stamping 16 is provided with a plurality of inwardly bowed sections 26 so that elongated port openings 28 are provided in longitudinally spaced relationship along the length of the gas burner at each upper lateral margin of the burner 10.

As a feature of the invention, prior to securing the upper and lower stampings together by the longitudinally spaced spot welds, a divider member, such as a flat metal bar 30, is positioned between the adjacent upper edges of the upper and lower stampings and the arms 17 and 19 thereon, which divider bar extends the length of the gas burner at the series of ports or openings 28 therein. The divider bar 30 is in the plane formed by the adjacent or substantially abutting surfaces of the arms 17 and 19 to divide these openings 28 into ports **28*a* and 28*b* as shown in FIG. 3. It will be noted that the openings are longer than they are wide whereby the divided openings 28*a* and 28*b*** are appreciably narrower than they are long and this aids in providing good twin jet ports at each of the openings for efficient functioning of the gas burner.

The gas burners 10 each have an individual U-shaped air control shutter 32 slidably engaged with the gas burner adjacent its input end and slidable axially therein to vary the amount of air pulled into the gas burner with the flow of gas thereto.

Figure 2:
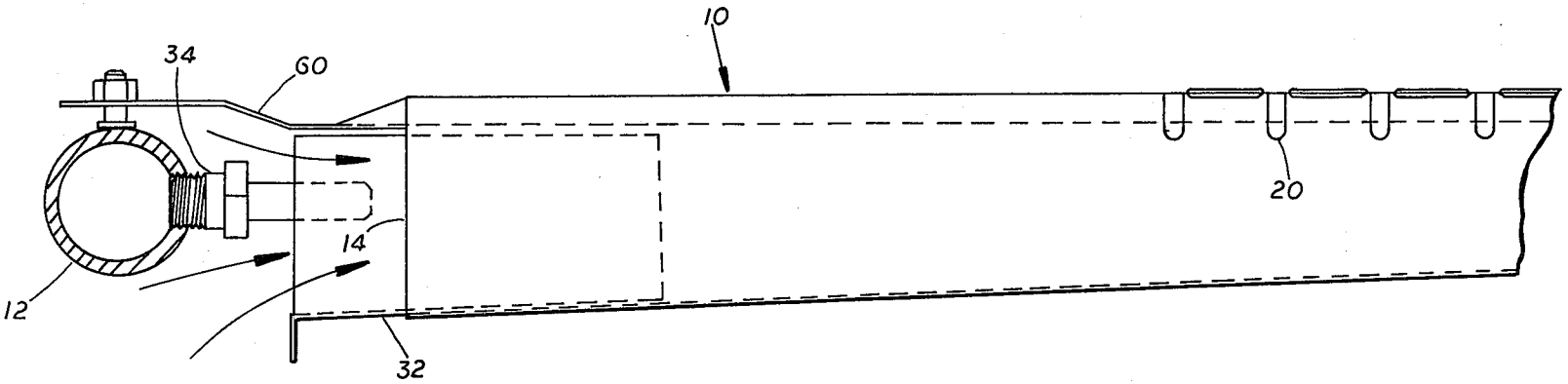
FIG. 2 is in the side elevation of a burner of FIG. 1.

FIG. 2 shows that the manifold 12 has a suitable gas jet means 34 removably secured thereto which gas jet means can be removed, when desired, for cleaning or other action. However, the length of the air shutter extending from the associated portion of the upper and lower stampings 16 and 18 can be varied so that different amounts of air will be drawn into the enclosure 22 by the gas jet flowing rapidly thereinto.

It is also a feature of the invention that a series of these burners can be controlled by just one pilot burner provided in association therewith. Hence, a crossover, indicated as a whole by the numeral 40, is secured to each one of the gas burners 10 and in this instance extends laterally therefrom to terminate immediately adjacent the next laterally associated burner. This crossover 40 comprises a tubular section or device 42 that connects at one end to one arm 19 of the lower stamping and through it to the interior of the enclosure 22 formed thereby so that the tubular device 42 receives a flow of gas-air mix with the remaining portions of the burner. The opposite end of the section or device 42 is closed. The tubular device 42 has a pair of upwardly extending sections 44 and 46 formed by the edges of a metal sheet, for example, forming the tubular device 42. These end sections extend vertically and are parallel but have a center portion or plate 48 secured therebetween. Such center plate 48 may rest on the lower port of the device 42 and it has a plurality of longitudinally spaced upwardly extending segments 50 provided thereon that are positioned between the end sections 44 and 46. These segments permit gas flow up there between and outwardly from the tubular device for the length thereof. Hence, any gas flames formed by the burner 10 will also extend laterally therefrom by the crossover 40 for transmission to and ignition of the adjacent gas burner for multiple servicing of gas burners from one pilot light.

In use of burners of the invention, it has been found that the use of a slide type air shutter 32 does not allow lint buildup at the air input end of the gas burner to curtail combustion by loss of primary air. Also, any type of gas, natural, mixed, manufactured, propane or butane, can be used without any changes in the port openings 28*a* and 28*b* but usually just the gas jet member 34 needs to be changed.

The burners of the invention are lightweight and they provide a low, intense concentrated flame area that hugs closely to the top of the burner. The burner can be made entirely from flat pieces of cold rolled steel and the air to gas ratio can be adjusted on the burner for maximum air supply without the flames lifting from the burner ports. Tests of the burner have shown that it remains cool in operation and it does not get hot enough to burn off an organic paint finish provided thereon. A uniformity of flames is obtained from the burner even at the extreme end thereof from the inlet opening end thereof. A high velocity of fuel-air mix can be used in the burner for increased efficiency resulting in a high combustion efficiency and economical use of the gas fuel. The twin turbo jet ports of the burner give a very efficient low flame for even heat over the entire heat exchanger surface.

A support bar 60 is secured to the burner to support it in a suitable manner. A lock screw 62 or the like engages the upper stamping 16 and engages the shutter 32 to secure it in a given position.

The crossovers 40 have good gas flow connection from the burner enclosure 22.

From the foregoing, it is believed that a novel, improved burner has been provided that has very desirable operating characteristics. Hence, the objects of the invention have been achieved by the low weight, efficient burner formed from a plurality of metal stampings that are secured or welded together in any suitable manner to form an air tight enclosure therefrom having a longitudinally aligned series of gas outlet ports provided therein.

While in accordance with the Patent Statutes only the preferred embodiment of the invention and the applicant's contemplated best mode for carrying out the same have been presented and described in detail, it is to be understood that the invention is not limited thereto or thereby. Consequently, for a true appreciation of the scope and breadth of the invention, reference should be had to the following claims.

What is claimed is:

1. A gas burner, comprising:

an elongated lower stamping member being generally U-shaped in section and having outwardly bowed sections spaced along the upper end of each arm thereof;

an elongated upper stamping member being generally U-shaped in section and having inwardly bowed sections spaced along the upper end of each arm thereof; the upper stamping member being received within the lower stamping member with the inwardly and outwardly bowed sections being in juxtaposition with each other; and a dividing bar longitudinally engaged between the upper ends of the arms of said upper and lower stamping members and separating said inwardly and outwardly bowed sections to define longitudinally spaced twin gas ports along an upper portion of the gas burner.

2. A gas burner as recited in claim 1 wherein said bowed sections are of greater length than width and are spaced longitudinally of the burner.

3. A gas burner as recited in claim 1 wherein said upper and lower stamping members are fixedly interconnected at points between said inwardly and outwardly bowed sections.

4. A gas burner as recited in claim 1 wherein an air control plate slidably engages said lower stamping member and protrudes therefrom a variable distance, said distance regulating air flow into the gas burner.

* * * * *